US005561994A

United States Patent [19]

Smith et al.

[11] Patent Number: 5,561,994

[45] Date of Patent: Oct. 8, 1996

[54] LOCK FOR SLIDING DOOR

[75] Inventors: John C. Smith, Letchworth; Patrick E. Christmas, Langford, both of United Kingdom

[73] Assignee: Schlegel (UK) Holdings Limited, Coalville, United Kingdom

[21] Appl. No.: 305,199

[22] Filed: Sep. 13, 1994

[30] Foreign Application Priority Data

Sep. 14, 1993 [GB] United Kingdom ..... 9319006

[51] Int. Cl.[6] ..... E05B 65/08

[52] U.S. Cl. ..... 70/99; 70/120; 70/95; 292/39; 292/DIG. 46

[58] Field of Search ..... 70/95, 99–100, 70/118, 120, 129, 134, 190; 292/39, 142, 160, 279, 336.3, DIG. 46

[56] References Cited

U.S. PATENT DOCUMENTS

| | | | |
|---|---|---|---|
| 430,072 | 6/1890 | Dowd | 70/118 |
| 1,240,403 | 9/1917 | Amato | 70/118 |
| 1,338,689 | 5/1920 | Massoll | 292/39 |
| 1,398,159 | 11/1921 | Sontow | 70/118 |
| 1,536,773 | 5/1925 | Ciaccio | 70/118 |
| 1,633,173 | 6/1927 | Freedman et al. | 70/118 |
| 1,876,193 | 9/1932 | Wolters | 70/118 |
| 1,996,865 | 4/1935 | Haag | 292/39 |
| 2,125,227 | 7/1938 | Hammarle | 70/118 |
| 2,668,071 | 2/1954 | Adams et al. | 70/97 |
| 2,787,154 | 4/1957 | Wesberry | 70/118 |
| 3,110,512 | 11/1963 | Scalf et al. | 292/39 |
| 3,390,557 | 7/1968 | Erickson et al. | 70/97 |
| 3,904,229 | 9/1975 | Waldo | 70/97 |
| 4,024,739 | 5/1977 | Kufman | 70/97 |
| 4,063,763 | 12/1977 | van Herpen | 292/160 |
| 4,476,700 | 10/1984 | King | 70/99 |
| 4,480,862 | 11/1984 | Fleming | 292/DIG. 46 |
| 4,563,885 | 1/1986 | Madden | 70/97 |
| 4,973,091 | 11/1990 | Paulson et al. | 292/DIG. 46 |
| 5,172,944 | 12/1992 | Munich et al. | 292/39 |

FOREIGN PATENT DOCUMENTS

| | | | |
|---|---|---|---|
| 35230 | 11/1908 | Germany | 70/118 |
| 402123 | 9/1924 | Germany | 70/29 |
| 1255 | of 1888 | United Kingdom . | |

*Primary Examiner*—Steven N. Meyers
*Assistant Examiner*—Tuyet-Phuong Pham
*Attorney, Agent, or Firm*—Cumpston & Shaw

[57] ABSTRACT

A lock for a sliding door has at least one locking bolt adapted in use to be moved between an open position and a locking position by activation of an operating member which rotates a pinion which engages a pair of drive racks to cause movement of the locking bolt generally parallel to the longitudinal axis of the bolt and in a direction parallel to a leading edge of a door in which the lock is mounted. The locking bolt is adapted when moved to its locking position to move into locking engagement with a staple-like keep mounted on a frame for the door when the door is in a closed position. A key operated deadlock facility prevents activation of the operating member. Preferably, the lock is also fitted with a safety mechanism so that it cannot be damaged if the door to which it is fitted is closed when the lock is in a locking position, and it is also possible to provide both an automatic latching and a panic feature on the lock.

15 Claims, 7 Drawing Sheets

LOCK FOR SLIDING DOOR

This invention relates to a lock for a sliding door. Although the lock has been specifically designed for sliding doors such as patio doors, it could be used for other sliding members, such as cupboard doors, windows, and the like.

Traditionally, locks for sliding doors have hook type bolts or mushroom headed bolts which protrude from the leading edge of the lock stile of the door and when the door is moved to a closed position, these bolts are either swung in an arc or slid bodily in a vertical direction to engage with a suitable keep member mounted in the door frame. In the case of a hook bolt, the keep member could be in the form of a bar, or an eye or staple, and in the case of a mushroom headed bolt, the keep member is normally a keyhole slot with the enlarged portion being sufficiently large to accommodate the head of the bolt, which is then slid behind the narrow portion of the keyhole slot. While such styles of lock operate satisfactorily and provide a secure closure, they suffer from the major disadvantage that they protrude from the lock stile at the leading edge of the door and can cause injury, catch on clothing, and generally look unsightly.

The present invention seeks to provide a lock which does not suffer from the above disadvantages.

Very often door locks of the above-described prior art types are fitted with an anti-slam device which is in the form of a further member projecting from the leading edge of the lock stile and so long as this remains in its projecting position, the lock is prevented from being moved to a locking position. Normally, when the sliding door is moved to a closed position, the projecting member will be caused to move against a spring bias so that it no longer projects from the lock stile and this then allows the lock to be moved to a locking position. Apart from suffering from the disadvantages mentioned above, anti-slam devices of the above-described known type also suffer from the disadvantage that they are difficult to fit due to the normal tolerances experienced between a sliding door and its frame and in practice this means that the projecting member of any anti-slam device fitted to a door has to be purpose made for the door, otherwise when the door is closed it may be moved into a lock stile by an insufficient amount (or it may be moved into the stile too far) to prevent satisfactory operation of the lock.

As a preferred feature, the lock of the present invention is so designed that even if the lock has been moved to a locking position in which locking pins thereof are in a door locking position but the door is still open, the lock mechanism cannot be damaged if the door is then slid to a closed position.

According to the present invention, we provide a lock for a sliding door, the lock having at least one locking bolt adapted in use to be moved between an open position and a locking position by activation of an operating member, movement of the locking bolt being generally parallel to the longitudinal axis of the bolt and in a direction parallel to a leading edge of a door in which the lock is mounted, the locking bolt being adapted when moved to its locking position to move into locking engagement with a staple-like keep mounted on a frame for the door when the door is in a closed position.

Preferably, the lock includes a housing in which said at least one locking bolt and operating member are supported and a keep plate from which the staple-like keep projects generally at right angles thereto, the keep plate being adapted for mounting in a frame member for the door and the housing being adapted for mounting in a lock stile in a leading edge of the door in line with and for co-operation with the keep plate.

Preferably, the operating member comprises a handle co-operating with a drive pinion supported for rotation in the housing, the drive pinion engaging with a rack to convert rotational movement of the drive pinion into longitudinal movement of the locking bolt.

Preferably, two locking bolts are supported in the housing, one to either side of, i.e. above and below, the drive pinion, the drive pinions preferably being mounted for longitudinal sliding movement in the housing, in opposite directions via respective drive racks mounted respectively on opposite sides, i.e. to the left and right, of the drive pinion, there being two staple-like keeps mounted on the keep plate for co-operation with respective ones of the locking bolts.

Preferably, there are two drive racks which engage with the pinion, one being located on each side of the pinion so that when the pinion is rotated by operation of the operating means (e.g. a handle), the racks will move in opposite directions. So that each locking bolt can be located at a front face of the lock, the drive rack remote from the front face is connected, via a lock plate which bridges the pinion and is located at right angles to the drive racks, to a drive plate which supports the second locking bolt.

Preferably, the drive rack and drive plate supporting the locking bolts have a pair of upstanding posts with which a plate portion of the locking bolt is engaged, there being slightly elongated apertures formed in the plate portion by means of which the plate portion is engaged with the posts, with the posts projecting through the longated apertures, and one post, preferably that furthest from the rack, having a coil spring mounted thereon, one end of which bears against the plate portion, and the other of which engages an abutment, which may be provided by a washer held in position by a circlip, on the end of the post. Thus, if the locking bolt is in a locking position, and the door in which the lock is fitted is moved to a closed position, no damage will be caused to the mechanism by the locking bolt hitting the top of a staple-like keep, since the locking bolt can merely rock about its connection with the drive rack (or drive plate).

The posts can also be used for connection of further locking bolts to the lock, or shoot bolts for the top and bottom of the door.

Preferably, the locking bolt is kinked and has a surface which is inclined so that as it is moved into its locking position and engaged within the staple-like keep, it will act as a cam surface to pull shut the door to which it is fitted.

Preferably, the lock is provided with a deadlock facility, which is provided by a standard lock mechanism and a moulded deadlock block which is movable by the standard lock mechanism between one position in which the lock can be operated, and another in which it cannot.

Preferably, the block has a projecting stud thereon which engages in an L-shaped slot provided in the locking plate, the longer arm of the L extending parallel to the direction of movement of the locking bolts and the shorter arm at right angles thereto, so that when the lock is in its locking position with the locking bolts extended, the stud on the locking plate will be located at the junction of the shorter and longer arms of the L, thus allowing the deadlock to be operated, which results in rocking movement of the deadlock block, to move the stud on the block towards the closed end of the shorter arm of the L. When the stud is in this position, the lock is deadlocked, since it is then impossible to move the locking plate, and hence the locking bolts, from their locking position.

To rock the block, there is a projecting snib on the standard lock mechanism which engages in a notch in one end of the block, the opposite end of which surrounds a pivot shaft of the pinion to provide a rocking axis for the block.

It is desirable that the deadlock block should be located either in an unlocked or a locked position, and for this purpose, the block is provided with a spring loaded catch on its underside, which locates to one side or the other of an upstanding projection on the inside of the lock housing, the catch being movable out of a blocking position to allow rocking of the block each time the deadlock is operated by being engaged by the snib of the deadlock and moved against the bias of its spring.

In an alternative construction which allows the lock to be fitted with automatic latching and panic release features, the block of the deadlock facility is mounted for rocking movement between a deadlocked and an open position, about a point between its ends, there being a deadlock pin projecting from a face of said block, and the said rack, which is engaged by said drive pinion, has an upstanding arm thereon, behind which said deadlock pin engages when said block is in its deadlocked position.

As in the previous construction, there is a projecting snib on the standard lock mechanism which engages in a notch in one end of the block, the opposite end of which terminates in a nose which engages with spring means to bias the block either to an open or to a deadlocking position. Preferably, the spring is supported on a boss on a support for the operating member.

Preferably, the drive rack and drive plate supporting the locking bolts each have only one upstanding post therein to which a plate portion of a locking bolt is attached, and, to provide four point locking, one end of a connecting bar is also mounted on each of said posts, a further post being mounted on the end of the connecting bar remote from the one end, and a further locking bolt being supported on said further post. This provides a locking location remote from the operating member.

Several embodiments of lock according to the invention are now described by way of example with reference to the accompanying drawings, in which.

Figure 2:
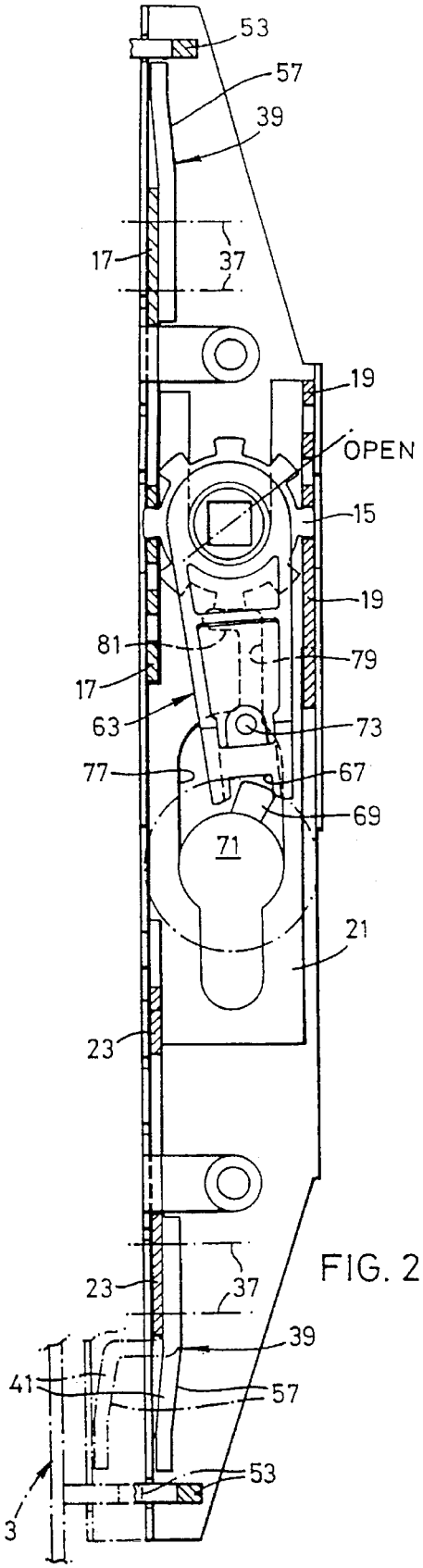
FIG. 2 is a side elevation of the lock, with a side plate removed, and with rear and front drive racks and a drive plate in section, showing a mechanism in an open position.

Referring to the drawings, the lock has a housing 1 adapted to be mounted upright in a lock stile in the leading edge of a sliding door (not shown) which co-operates with a keep plate 3 adapted to be mounted opposite the housing in a frame (not shown) for the door, so as to co-operate therewith. The housing is comprised of a front side plate 5 and a rear side plate which is largely a mirror image of the plate 5, there being suitable flanges down each edge of the front and rear plates, the free edges of which may abut, the two plates being connected together by rivets 7 (or by other known means) and correctly spaced apart by suitable spacers (not shown). The two side plates support an operating member shown generally at 9 and a deadlock mechanism 11 of known construction, largely in known manner. The operating mechanism has a central aperture 13 of square cross-section to receive a drive spindle which may be connected to a handle in known manner, operation of the handle causing rotation of a drive pinion 15. The drive pinion 15 engages with first and second drive racks 17 and 19, the former being located within the housing at its front edge and the latter at its rear edge, so that when the drive pinion 15 is rotated clockwise as shown in FIG. 2, the rack 17 will move upwards and the rack 19 will move downwards.

Figure 5:
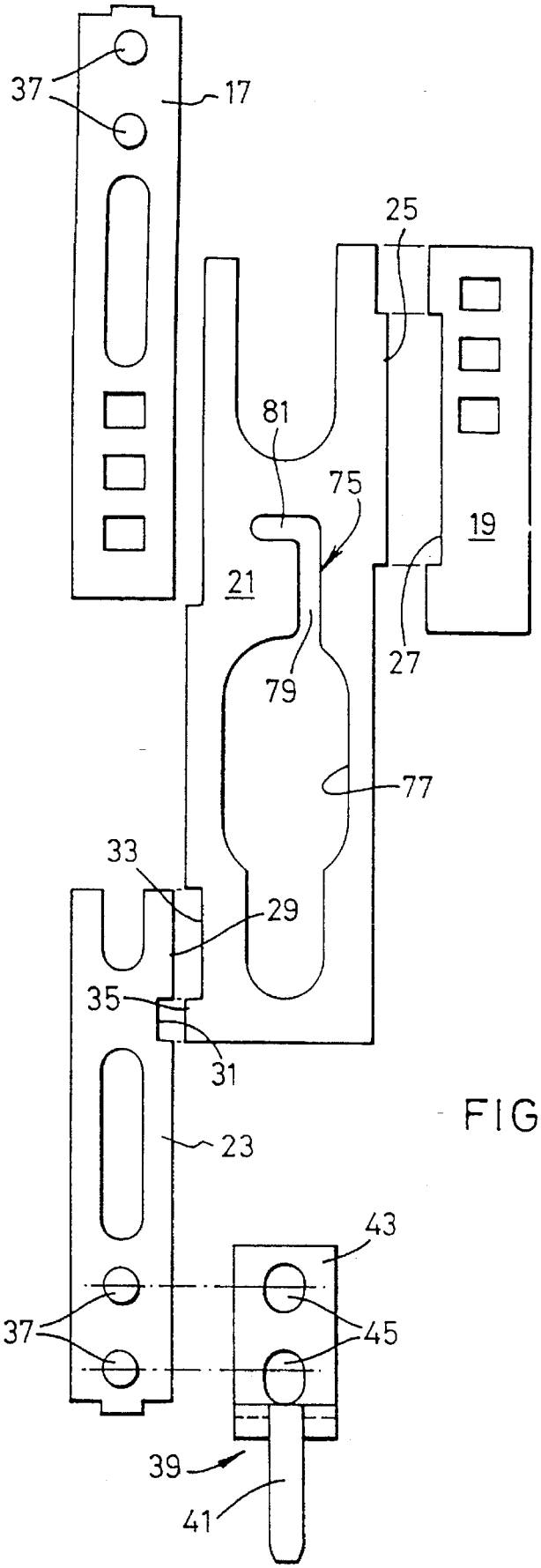
FIG. 5 is an exploded or developed view showing two drive racks, a lock plate, a drive plate and one lock bolt.

As can be seen from FIG. 5, the drive rack 19 is connected via a lock plate 21 to an intermediate drive plate 23 in vertical alignment with the drive rack 17, this being necessary because the drive rack 19 is located on the innermost side of the drive pinion 15. The lock plate 21 extends across the whole width of the housing and is located at right angles to the racks 17, 19 and intermediate drive plate 23, a projection 25 on a rear edge of the plate 21 matingly engaging in a recess 27 in the rack 19, and a projection 29 on the drive plate 23 engaging within a recess 33 in the plate 21 with a projection 35 on the plate 21 likewise engaging in a recess 31 in the drive plate 23. Thus, when the drive pinion 15 is rotated, the drive rack and drive plate 23 located at the front edge of the housing 1 will move in opposite directions.

Figure 10:
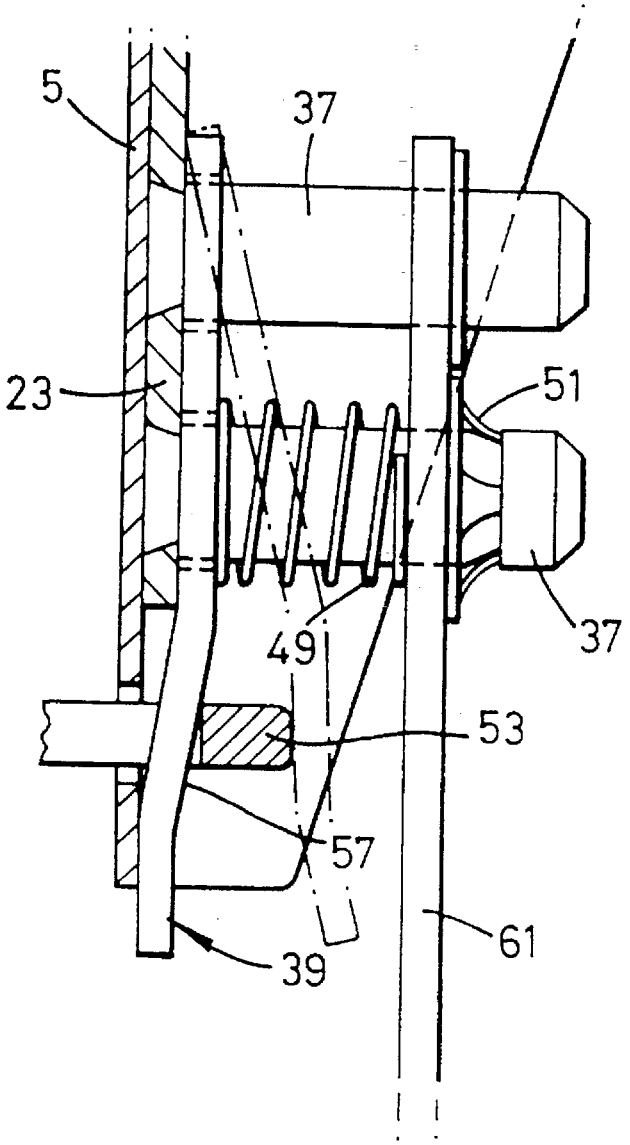
FIG. 10 is an enlarged sectional elevation showing how a locking bolt is attached to a drive pinion or drive plate, to provide an anti-slam facility, and showing how a head or sill bolt can be fitted to the lock.

As can be seen from FIGS. 1–3 and 10, each of the rack 17 and drive plate 23 has a pair of spaced upstanding posts 37 projecting from its outer face at one end thereof by means of which a locking bolt 39 is supported thereon. A locking bolt is shown in detail in FIG. 5, the bolt having a generally cylindrical pin portion 41 projecting from one end of a plate portion 43, the plate portion having two slightly elongated circular apertures 45 therein by means of which the locking bolt is supported on its respective drive rack 17 or plate 23. The front and rear housing plates can have different widths dependent upon the amount by which the lock is to be set back within the lock stile, adjustment in width being provided simply by moving forward as necessary a front edge 47 of each side plate. Differences in width of the housing are accommodated by using different sized locking bolts, five different sized bolts being illustrated in FIG. 6. Each bolt 39 is adjustably supported on its posts 37 as shown in FIG. 10 with the plate 43 lifting on its respective rack 17 or plate 23 and being held there by a coil spring 49, one end of which bears against an inner face of the plate 43 and the other end of which bears against the under face of a washer held on the respective post 37 by a circlip or in any other known manner (not shown in the drawings). This method of mounting the locking bolt on its drive rack ensures that the lock mechanism is not damaged in the event that a door to which the lock has been fitted is moved to a closed position when the lock has inadvertently itself been moved to a locked position, as will hereinafter be described.

As is apparent from FIGS. 1–3 and FIG. 10, each of the bolts 39 is designed to co-operate with a staple-like keep 53 projecting from a respective end of the keep plate 3. The staple-like keeps 53 are of generally U-shapes construction with the free ends of the U's rivetted in position within the plate 3 or otherwise locked thereon, e.g. by welding. When the lock is in its open position and a door to which it is fitted is closed, the front face of the housing or a face plate 55 mounted thereon in known manner will move to a position closely adjacent the keep plate 3 with the staple-like keeps 53 passing through apertures in the front face of the housing and/or the face plate 55 so as to project within the housing, and the pin portions 41 of the bolts 39 will be located with their free ends slightly inboard of the respective keeps 53, provided the lock is in its open position. To move the lock to its closed or locking position, the operating member is rotated so as to move the rack 17 and drive plate 23 apart, thereby causing the pin portions 41 of the respective locking bolts to engage within the U-shaped keeps 53. Because each of the pin portions 41 has a slightly inclined locking face 57 (see FIG. 6), this locking face, in bearing against the underside of the base of the U-shaped keep, will pull the door to which the lock has been fitted tightly closed. Should the lock have inadvertently been moved to its locked position prior to closure of the door, the face of each locking pin opposite the face 57 will strike the outer surface of the base of its U-shaped keep 53 and the whole locking bolt will rock inwards against the action of the coil spring 49. If the lock is then activated to withdraw the locking bolts and move them again to their locking position, the act of withdrawing the bolts will allow the springs 49 to bias them back to their illustrated positions, whereupon the bolts can be moved to their locking position (see FIG. 10).

Figure 6:
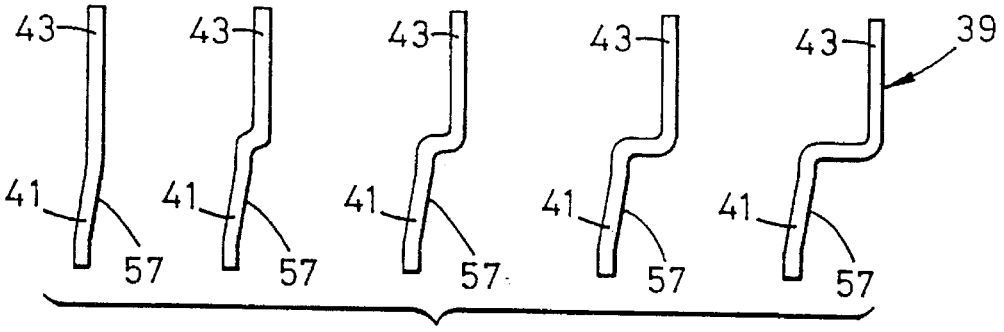
FIG. 6 shows the kinked shapes of five different locking bolts for locks of different widths.

If a wider housing is used rather than that illustrated, then one of the alternative locking bolts 39, as illustrated in FIG. 6, will be used, that with the largest kink therein being designed for the widest lock housing. As can be seen from FIG. 2, a heavily kinked locking pin is shown therein in chain lines.

Figure 1:
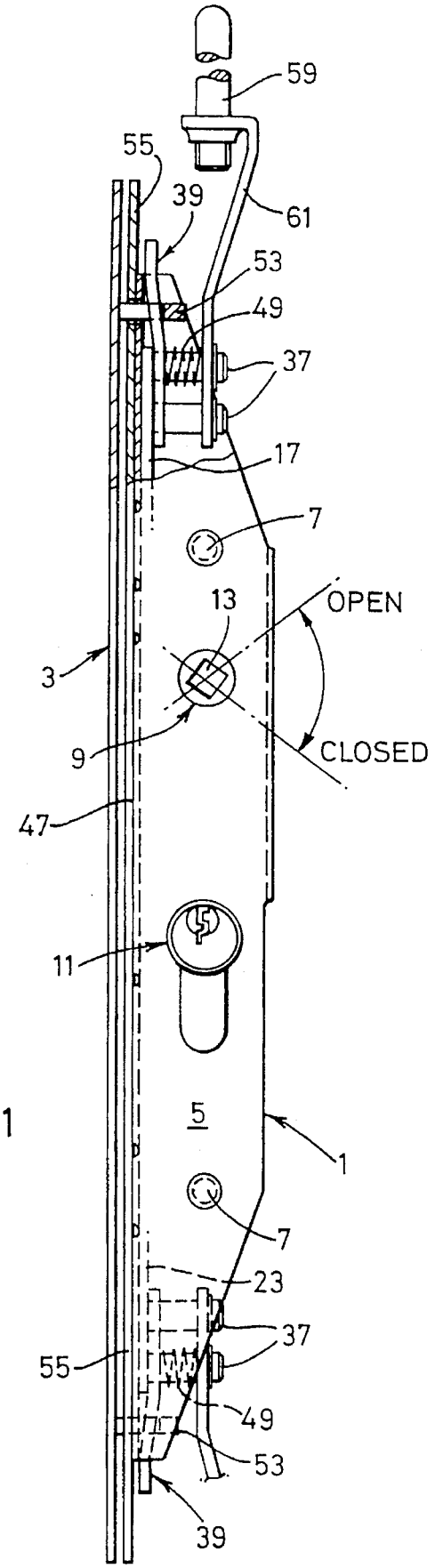
FIG. 1 is a side elevation of the lock with its associated keep.

If desired, the above-described mechanism can also be used to drive head and sill bolts, a head bolt being shown at 59 in FIG. 1 connected to a drive bar 61 in known manner, the drive bar 61 being supported upon the two posts 37. A similar drive bar for a sill bolt is also illustrated. As is apparent from FIG. 10, the drive bar 61 is supported on the posts 37, and held in position by a spacing washer 51, with the spring 49 bearing against a face of the bar 61, instead of against a washer.

Figure 3:
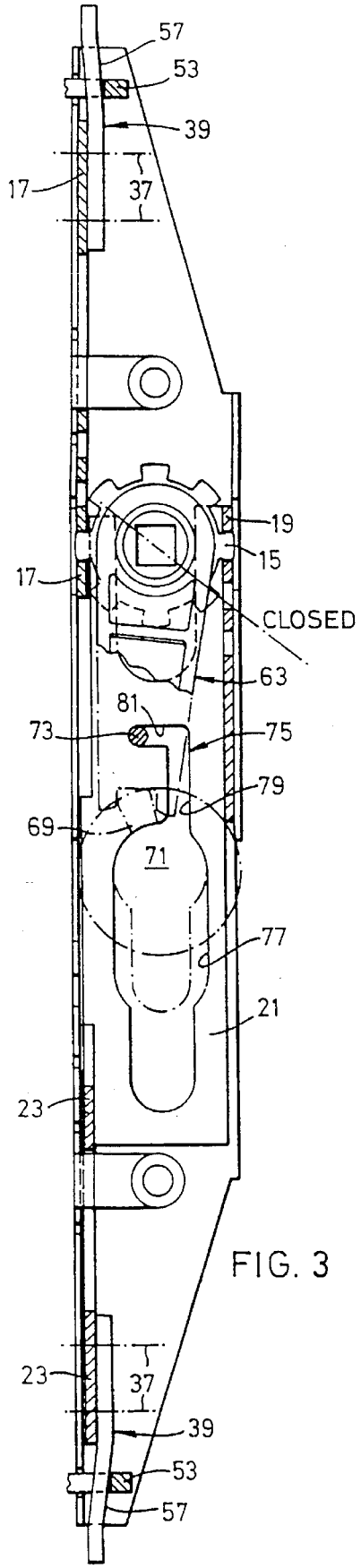
FIG. 3 is a view similar to FIG. 2, but showing the mechanism in a closed or locking position, and deadlocked.
Figure 7:
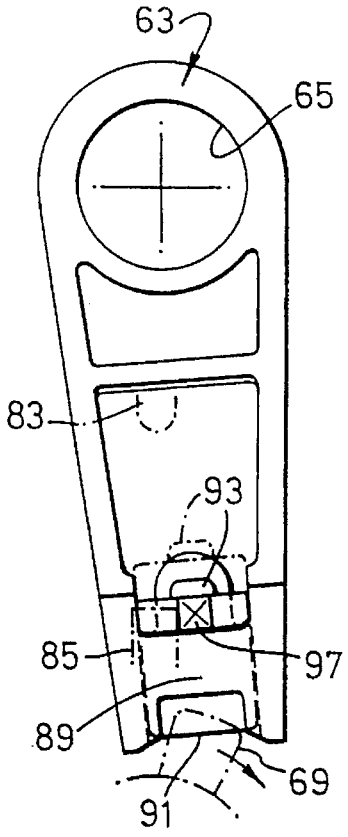
FIG. 7 shows, to an enlarged scale, a moulded deadlock block in the FIG. 2 position.
Figure 8:
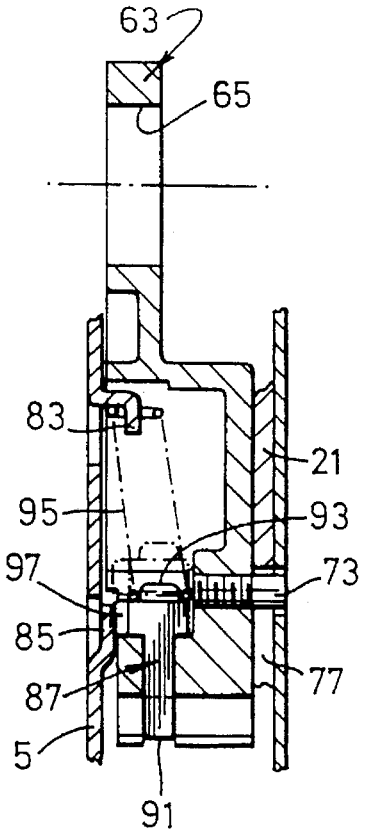
FIG. 8 is a section through the block of FIG. 7, and part of the lock.
Figure 9:
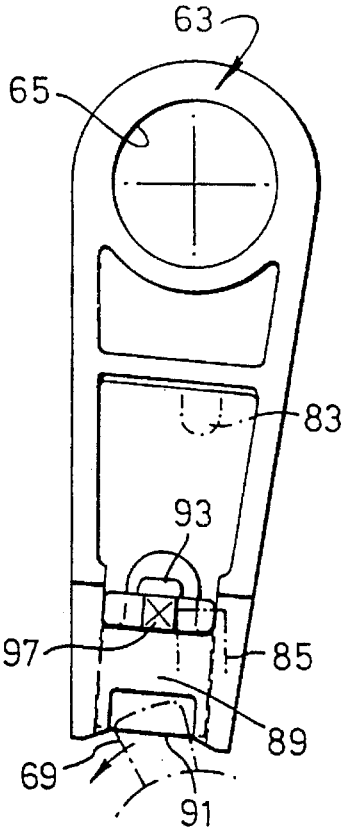
FIG. 9 is a view similar to FIG. 7, with the block in the FIG. 3 position.

The lock has a deadlocking facility operated by the deadlock 11 which will now be described in greater detail. As can be seen in FIGS. 2 and 3, a moulded deadlock block 63 is supported on the rear side plate of the housing 1. As can be seen in FIGS. 7–9, the block 63 has a circular aperture 65 at one end by means of which the block is pivotally supported on a cylindrical portion of the operating member 9 and its opposite end is bifurcated as shown at 67 to receive a projecting snib 69 of a standard key operated deadlocking mechanism 71. Inboard from the bifurcated end 67 of the block 63 a projecting stud 73 is provided which locates within an L-shaped slot 75 formed in the locking plate 21, the slot 75 being formed as an extension of a central aperture 77 in the plate 21 which allows the plate to slide relative to the mechanism 71. When the deadlock 71 is in its unlocked position, as shown in FIG. 2, the stud 73 will be located in a longer arm 79 of the L-shaped slot 75, thus allowing the lock mechanism to be operated using the operating member 9 and hence the locking plate 21 can slide up and down as shown in FIGS. 1–3 relative to the deadlock 71 and the stud 73. However, if the locking mechanism is moved to a locking position, the stud 73 will be located at the inner end of the arm 79 of the L-shaped slot 75 at its junction with a shorter arm 81. By rotating the key of the deadlock 71, its snib 69 will be rocked into engagement with the birfurcated end 67 of the block 63 and the block can then rock clockwise, as shown in FIG. 2, to its FIG. 3 position, since the stud 73 on the block can move into the shorter arm 81 of the slot 75. Once so located therein this will prevent lengthwise (i.e. up and down) sliding movement of the lock plate 21. Since the plate 21 cannot move, the plate 23 and locking bolt 39 mounted thereon cannot be moved to an unlocked position and likewise the rack 19 cannot move due to its interengagement at 25, 27 with the plate 21, thus preventing rotation of the drive pinion 15 which in turn prevents longitudinal movement of the drive rack 17, thus holding the locking bolt 39 mounted thereon in its locking position. The locking mechanism is now deadlocked. Unlocking of the deadlock is achieved merely by operating the deadlock mechanism to move the snib 69 clockwise, thus rocking the block 63 counter-clockwise to move the stud 73 to the junction of the arms 81 and 79 of the slot 75 (i.e. from the FIG. 3 to FIG. 2 position), whereupon operation of the operating member will allow the lock to move to an unlocked position.

Figure 4:
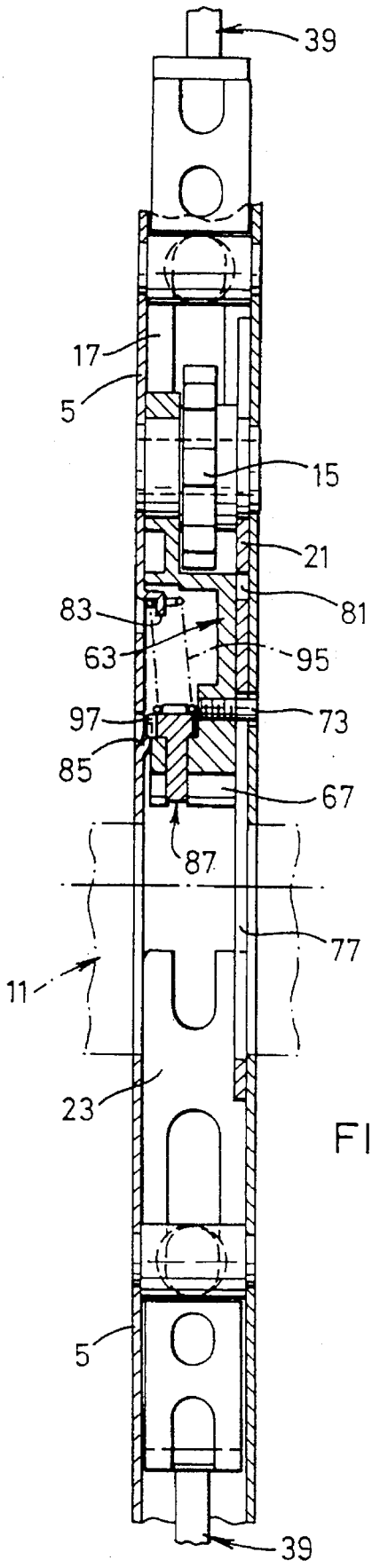
FIG. 4 is a transverse section on the centre line of FIG. 2.

Because the deadlock mechanism has to be rotatable through 360° in known manner, to enable key removal, the snib 69 will not always remain in engagement with the birfurcated end 67 of the block 63 and means must therefore be provided to hold the block 63 either in a position to enable deadlocking to take place (FIG. 2) or in a deadlocked position (FIG. 3). For this purpose, a spring loaded catch is provided on the underside of the block 63 as shown in FIGS. 7–9. The lower side plate of the housing 5 has a hook-shaped lug 83 formed thereon, e.g. by a stamping operation, and a projection 85 is also formed on this side plate between the lug 83 and an aperture therein which receives the deadlock mechanism 71. A catch 87 of generally L-shaped construction, shown in FIGS. 4 and 8, is slidably supported in a slot in a transverse body portion 89 of the block 63, with a part 91 projecting beyond the slot into the bifurcated portion 67 as shown in FIGS. 7–9. At its end remote from part 91, the catch 87 has a nose portion 93 to support one end of a coil spring 95, the opposite end of which is engaged with the lug 83 projecting from the lower housing side plate. Thus, the catch is biassed to the position shown in FIG. 8. Also provided on the catch 87 is a nib 97 designed to abut the projection 85 on the lower side plate when the catch is biassed to its FIG. 8 position. To cause the catch 87 to be moved against the bias of its spring 95, the snib 69 of the deadlock mechanism is swung by operation of the key of the deadlock into engagement with the bifurcated portion 67 of the block 63 and as this occurs so the snib 69 will engage the projecting part 91 and move it upwardly as viewed in FIGS. 7 and 8 against the bias of the spring 95. This will move the nib 97 beyond the influence of projection 85 thus allowing the block 63 to swing clockwise to its deadlocking position shown in FIG. 9, whereupon the spring 95 will cause the nib 97 to move downwards on the other side of the projection 85, thus holding the block 63 in its deadlock position. If the key is subsequently removed from the deadlock mechanism, the block 63 will remain in this position until the key is used again and if an attempt is made to unlock the deadlock mechanism, so the snib of the deadlock will again contact part 91 of the catch to release its nib 97 until it is again permitted to be moved outwards, where it is again influenced by the projection 85 to hold block 63 in its unlocked position.

Figure 11:
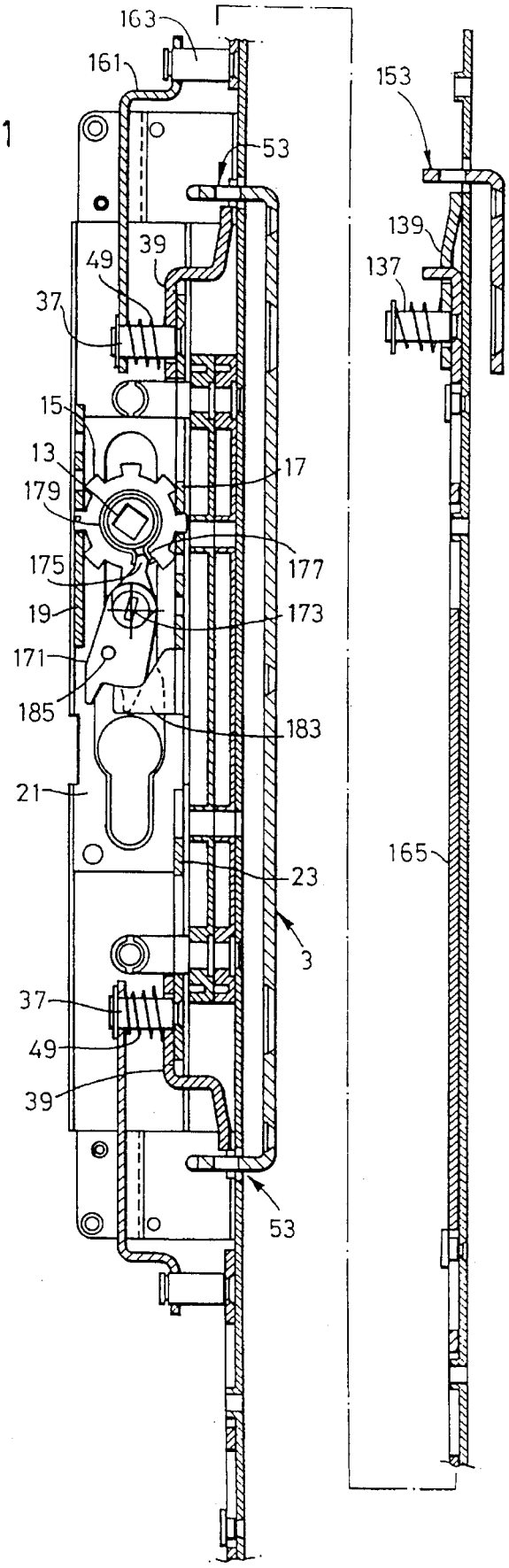
FIG. 11 is a view similar to FIG. 2 of a modified lock capable of being fitted with automatic latching and panic release features.
Figure 12:
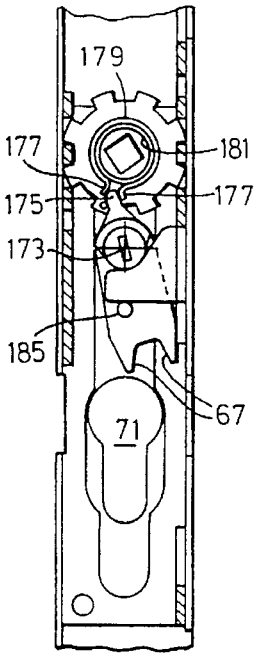
FIG. 12 is a scrap view showing the lock of FIG. 11 in a closed or locking position, and deadlocked.

Referring now to FIGS. 11 and 12, the modified lock shown therein has parts similar to those in the embodiment shown in FIG. 2 which are identified by the same reference numerals. It should be noted, however, that at each end of the lock, only one post 37 projects from the respective rack 17, and plate 23, and accordingly only one recess 45 is provided in the locking bolts 39 for engagement therewith.

Furthermore, instead of being provided with head and sill bolts the lock can be fitted with additional front face locking bolts 139, there being a connecting bar 161 extending between the post 37 and a further post 163 on one end of a slide 165, on the opposite end of which there is another upstanding post 137 on which the bolt 139 is mounted in the same manner as the bolt 39. This bolt 139 engages with a supplementary U-shaped keep 153.

The deadlocking facility for the lock also differs from that of FIG. 2 in that instead of a block 63, a deadlock aluminium casting or block 171 is provided, which is mounted for pivotal movement about a pivot point 173. As with the block 63, the block 171 has a bifurcated end 67 which is engaged by a projecting snib (not shown) of a key operated deadlocking mechanism 71. At its opposite end, the block 171 terminates in a nose 175 which engages between the projecting arms 177 of a spring 179 frictionally engaged upon a cylindrical boss 181 on the support for the operating member 9. Hence, when the lock is not deadlocked and the block 171 is in the position shown in FIG. 11, the operating member 9 can move the lock to its closed position, which will move the rack 17 upwards as shown in FIG. 11, and engage the bolts with their keeps.

An upstanding arm 183 projects from the rack 17, and this will also move upwards (as shown in FIG. 11) with the rack. When the deadlock mechanism 71 is operated, the plate 171 will rock anti-clockwise from its FIG. 11 to its FIG. 12 position, the arm 177 of the spring 179 providing initial resistance, until the force tending to move the block is sufficient to overcome the friction of the spring on the boss 181, whereupon the whole spring will rock about the boss 181 to its FIG. 12 position. A deadlock pin 185 projects from the exposed face of the block 171, and upon activation of the deadlock, this will move behind the arm 183 as shown in FIG. 12, thus preventing the lock from being moved by operation of the operating member 9 to its open position. Hence, the lock is deadlocked. To move the lock to an open position, the deadlocking mechanism must be moved anti-clockwise as shown in FIG. 12, so as to swing the block 171 clockwise, against the initial reaction of the spring 179, until the pin 185 no longer stops the arm 183 and hence the rack 17 (and the other racks) from moving.

This construction of lock allows us to fit to the lock, using traditional lock furniture, an automatic latching mechanism, i.e. additional springs and latches which, on closing a door to which the lock is fitted, are released automatically to release the locking bolts. The action of opening the door will then reset the mechanism. It also allows us, using special furniture, to provide a panic feature. When this is fitted, the door can be opened from inside by operation of the operating member (handle) but is still secure from outside. There is a lost motion mechanism within the internal handle which disengages the deadlocking mechanism to allow the door to be opened from the inside only.

It will of course be understood that the present invention has been described above purely by way of example, and modifications of detail can be made within the scope of the invention.

What is claimed is:

1. A lock for a panel of the type slidable in a frame between an open position and a closed position in which a leading edge of the panel abuts an upright member of the frame comprising:

a lock mechanism;

a housing for the lock mechanism;

a keep plate mounted in the frame and having two staple-shaped keep members, each keep member having at least one free end attached to the keep plate and a base end extending towards the housing; and an opening in the housing for receiving the base end of each keep member within the housing when the panel is closed;

the lock mechanism including an operating member and two locking bolts within the housing coupled to the operating member for movement generally parallel to a leading edge of the housing between open and locked positions in response to movement of the operating member, each bolt passing through the base end of one of the keep members in the locked position for engaging a base of the keep member and capturing the keep member within the housing to prevent the panel from being opened;

the operating member having a handle co-operating with a drive pinion supported for rotation in the housing, the drive pinion engaging with a pair of racks to convert rotational movement of the drive pinion into longitudinal movement of the locking bolts; and wherein the locking bolts are located one above and one below the drive pinion, the locking bolts being mounted for longitudinal sliding movement in the housing, in opposite directions via respective ones of the pair of drive racks mounted respectively on opposite sides of the drive pinion.

2. The lock of claim 1 in combination with a door slidable in a frame which frame has a U-shaped cross section for receiving a leading edge of the door, in which the keep members are short enough that the base end does not extend beyond the frame when the door is open.

3. The lock of claim 1 in which the housing is adapted for mounting in a lock stile in a leading edge of the door in line with and for co-operation with the keep members.

4. The lock of claim 1, in which each keep member is U-shaped and is attached to the keep plate by both legs.

5. A lock according to claim 1, wherein there are two drive racks which engage with the pinion, one being located on each side of the pinion so that when the pinion is rotated by operation of the operating means, the racks will move in opposite directions.

6. A lock according to claim 5, wherein the drive rack remote from the leading edge is connected, via a lock plate which bridges the pinion and is located at right angles to the drive racks, to a drive plate which supports one of the locking bolts.

7. A lock according to claim 6, wherein the drive rack and drive plate supporting the locking bolts have a pair of upstanding posts with which a plate portion of the locking bolt is engaged, there being elongated apertures formed in the plate portion by means of which the plate portion is engaged with the posts, with the posts projecting through the longated apertures, and one post having a coil spring mounted thereon, one end of which bears against the plate portion, and the other of which engages an abutment on the end of the post.

8. A lock according to claim 7, wherein each locking bolt is kinked and has a surface which is inclined so that as it is moved into its locking position and engaged within the keep members it will act as a cam surface to pull shut the panel to which it is fitted.

9. A lock according to claim 6, wherein the drive rack and drive plate supporting the locking bolts each have only one upstanding post thereon to which a plate portion of a locking bolt is attached, and wherein one end of the connecting bar is also mounted on each of said posts, a further post being mounted on the end of the connecting bar remote from the one end, and a further locking bolt being supported on said further post to provide a locking location remote from the operating member.

10. A lock according to claim 6, also including a deadlock facility, comprising a deadlock block which is moveable by the lock mechanism between one position in which the lock can be operated, and another in which it cannot, wherein the block has a projecting stud thereon which engages in an L-shaped slot provided in the locking plate, a longer arm of the L extending parallel to the direction of movement of the locking bolts and a shorter arm at right angles thereto, so that when the lock is in its locking position with the locking bolts extended, the stud on the locking plate will be located at the junction of the shorter and longer arms of the L, thus allowing the deadlock to be operated, which results in rocking movement of the deadlock block, to move the stud on the block towards the closed end of the shorter arm of the L.

11. A lock according to claim 10, wherein there is a projecting snib on the lock mechanism which engages in a notch in one end of the block, the opposite end of which surrounds a pivot shaft of the pinion to provide a rocking axis for the block.

12. A lock according to claim 10, wherein the block is provided with a spring loaded catch on its underside, which locates to one side or the other of an upstanding projection on the inside of the lock housing, the catch being movable out of a blocking position to allow rocking of the block each time the deadlock is operated by being engaged by the snib of the deadlock and moved against the bias of its spring.

13. A lock according to claim 10, wherein the block is mounted for rocking movement between a deadlocked and an open position, about a point between its ends, and has a deadlock pin projecting from a face of said block, and wherein said rack engaged by said drive pinion has an upstanding arm thereon, behind which said deadlock pin engages when said block is in its deadlocked position.

14. A lock according to claim 13, wherein there is a projecting snib on the standard lock mechanism which engages in a notch in one end of the block, the opposite end of which terminates in a nose which engages with spring means to bias the block either to an open or to a deadlocking position.

15. A lock according to claim 14, wherein the spring means is supported on a boss on a support for the operating member.

* * * * *